US007175542B2

(12) United States Patent
Watanabe et al.

(10) Patent No.: US 7,175,542 B2
(45) Date of Patent: Feb. 13, 2007

(54) MULTI-PIECE SOLID GOLF BALL

(75) Inventors: Hideo Watanabe, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 119 days.

(21) Appl. No.: 11/100,456

(22) Filed: Apr. 7, 2005

(65) Prior Publication Data

US 2006/0229143 A1 Oct. 12, 2006

(51) Int. Cl.
*A63B 37/06* (2006.01)

(52) U.S. Cl. ..... 473/374

(58) Field of Classification Search ..... 473/373, 473/374, 376, 368
See application file for complete search history.

(56) References Cited

U.S. PATENT DOCUMENTS

| | | | | |
|---|---|---|---|---|
| 4,781,383 | A | 11/1988 | Kamada et al. | |
| 5,002,281 | A | 3/1991 | Nakahara et al. | |
| 5,072,944 | A | 12/1991 | Nakahara et al. | |
| 5,601,502 | A | 2/1997 | Hiraoka et al. | |
| 6,129,640 | A * | 10/2000 | Higuchi et al. | 473/374 |
| 6,194,505 | B1 | 2/2001 | Sone et al. | |
| 6,551,202 | B1 | 4/2003 | Yoshida | |
| 6,561,925 | B2 * | 5/2003 | Watanabe et al. | 473/371 |
| 6,642,314 | B2 | 11/2003 | Sone et al. | |
| 6,723,009 | B2 | 4/2004 | Kato | |
| 6,855,074 | B2 | 2/2005 | Kato | |
| 2001/0016522 | A1 * | 8/2001 | Watanabe et al. | 473/371 |
| 2002/0055399 | A1 | 5/2002 | Kato | |
| 2003/0211902 | A1 | 11/2003 | Kato et al. | |
| 2004/0033847 | A1 * | 2/2004 | Higuchi et al. | 473/371 |

FOREIGN PATENT DOCUMENTS

| | | | |
|---|---|---|---|
| JP | 62-181069 | A | 8/1987 |
| JP | 64-080377 | A | 3/1989 |
| JP | 2-228978 | A | 9/1990 |
| JP | 2-264674 | A | 10/1990 |
| JP | 7-194734 | A | 8/1995 |
| JP | 11-035633 | A | 2/1999 |
| JP | 11-164912 | A | 6/1999 |
| JP | 2001-161858 | A | 6/2001 |
| JP | 2002-078827 | A | 3/2002 |
| JP | 2002-85590 | A | 3/2002 |
| JP | 2002-293996 | A | 10/2002 |
| JP | 2003-10359 | A | 1/2003 |
| JP | 2003-325702 | A | 11/2003 |
| JP | 2004-136075 | A | 5/2004 |

* cited by examiner

*Primary Examiner*—Raeann Gorden
(74) *Attorney, Agent, or Firm*—Sughrue Mion, PLLC

(57) ABSTRACT

A multi-piece solid golf ball is composed of a multilayer core having at least an inner core layer and an outer core layer, one or more cover layer which encloses the core, and numerous dimples formed on a surface of the cover layer. The golf ball is characterized in that at least one cover layer is made primarily of an ionomer resin, the following hardness conditions (1) to (3) are satisfied:

(1) (JIS-C hardness of cover)−(JIS-C hardness at center of core)≧27, (2) 23≦(JIS-C hardness at surface of core)−(JIS-C hardness at center of core)≦40, and (3) 0.50≦[(deflection amount of entire core)/(deflection amount of inner core layer)]≦0.75, the number of dimples is from 250 to 390 dimples, and the ball has an initial velocity of at least 76.8 m/s. These features enable the ball to travel a longer distance.

8 Claims, 2 Drawing Sheets

MULTI-PIECE SOLID GOLF BALL

BACKGROUND OF THE INVENTION

The present invention relates to a multi-piece solid golf ball composed of a multi-layer core enclosed within a cover having one or more layers. More specifically, the invention relates to a multi-piece solid golf ball which has an excellent feel on impact and an excellent rebound, and in which, by forming the core so as to be soft on the inside and hard on the outside to reduce spin, and by providing optimal dimples on this ball construction, a better travel distance is achieved.

Numerous multi-piece solid golf balls having a multilayer construction in which the core hardness, cover hardness and dimples on the ball have been variously improved are described in the prior art. Such golf balls are disclosed in, for example, JP-A 62-181069, JP-A 64-80377, JP-A 2-228978, JP-A 2-264674, JP-A 7-194734, JP-A 2001-161858, JP-A 2002-78827, JP-A 2002-85590, JP-A 2003-10359, JP-A 2003-325702 and JP-A 2004-136075.

However, the improvement in distance achieved in these prior-art solid golf balls leaves something to be desired. There is room for further improvement in such golf balls to attain even longer distances.

SUMMARY OF THE INVENTION

The object of the invention is to provide a multi-piece solid golf ball which exhibits good aerodynamic properties, provides a further improvement in travel distance over that of prior-art balls, and also has a good feel on impact and an excellent scuff resistance.

As a result of extensive investigations, we have discovered that by giving the core a multilayer construction and thereby imparting to the core a specific hardness relationship between the interior and exterior of the core, by imparting the ball with a specific hardness relationship between a cover layer composed primarily of ionomer resin and the core, and by providing optimal dimples on the surface of this ball construction, there can be obtained a golf ball having a better travel distance for the golfer than prior-art balls, and having also an excellent feel on impact and an excellent scuff resistance. In particular, we have also found that when optimal dimples are provided on a ball construction in which lower spin has been achieved by forming the core so as to be soft on the inside and hard on the outside, a golf ball having a better travel distance can be obtained.

Accordingly, the invention provides a multi-piece solid golf ball composed of a multilayer core having at least an inner core layer and an outer core layer, one or more cover layer which encloses the core, and numerous dimples formed on a surface of the cover layer. The golf ball is characterized in that at least one cover layer is made primarily of an ionomer resin, the following hardness conditions (1) to (3) are satisfied:

(1) (JIS-C hardness of cover)−(JIS-C hardness at center of core)≧27, (2) 23≦(JIS-C hardness at surface of core)−(JIS-C hardness at center of core)≦40, and (3) 0.50≦[(deflection amount of entire core)/(deflection amount of inner core layer)]≦0.75, the number of dimples is from 250 to 390, and the ball has an initial velocity of at least 76.8 m/s.

In the invention, "deflection amount" refers to the amount of deformation (mm) by a spherical object such as the entire core or the inner core layer when a final load of 1,275 N (130 kgf) is applied thereto from an initial load state of 98 N (10 kgf).

BRIEF DESCRIPTION OF THE DIAGRAMS

DETAILED DESCRIPTION OF THE INVENTION

The invention is described more fully below.

Figure 1:
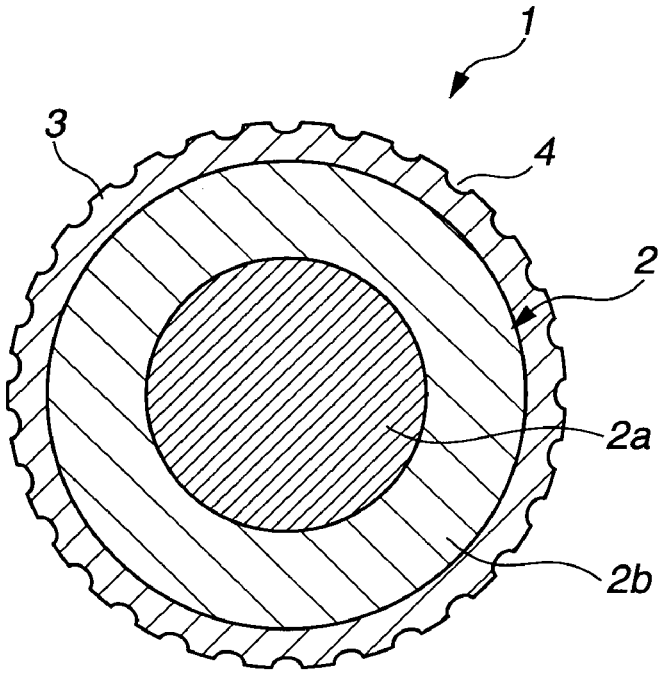
FIG. 1 is a schematic cross-sectional view of a multi-piece solid golf ball according to one embodiment of the invention.

The multi-piece solid golf ball of the invention includes a multilayer core having at least an inner core layer and an outer core layer, one or more cover layer which encloses the core, and numerous dimples formed on a surface of the cover layer. An example is the ball having the construction shown in FIG. 1. Referring to FIG. 1, the symbols 2*a* and 2*b* represent an inner core layer and an outer core layer, respectively, the symbol 2 represents the entire core, the symbol 3 represents the cover layer, and the symbol 4 represents a dimple.

The deflection amount of the entire core is generally at least 3.0 mm, preferably at least 3.3 mm, and more preferably at least 3.5 mm, but generally not more than 6.0 mm, preferably not more than 5.0 mm, and more preferably not more than 4.0 mm. At a deflection amount of less than 3.0 mm, the golf ball may undergo an excessive rise in spin, reducing the carry, and the feel of the ball on impact may become harder. On the other hand, at a deflection amount greater than 6.0 mm, the rebound may decrease, resulting in a shorter carry, the ball may have too soft a feel on impact, and the durability of the ball to cracking with repeated impact may worsen.

The entire core has a diameter of generally at least 35 mm, and preferably at least 36 mm, but generally not more than 41 mm, preferably not more than 40 mm, and more preferably not more than 39 mm. The entire core has a weight of generally 27 to 40 g, and preferably 33 to 38 g.

The center of the core has a hardness (which corresponds to the hardness at the center of the inner core layer), expressed as the JIS-C hardness, of generally at least 30, preferably at least 40, and more preferably at least 45, but generally not more than 60, preferably not more than 55, and even more preferably not more than 53. If the center of the core has a JIS-C hardness of more than 60, the spin may rise excessively, lowering the carry of the ball, and the ball may have a hard feel on impact. On the other hand, if the center of the core has a JIS-C hardness of less than 30, the ball may have a smaller rebound and less carry, the feel on impact may be too soft, and the resistance to cracking with repeated impact may worsen.

The core surface has a hardness, expressed as the JIS-C hardness, of generally at least 65, preferably at least 70, and more preferably at least 75, but generally not more than 90, preferably not more than 85, and more preferably not more than 80. If the surface of the core has a JIS-C hardness of more than 90, the ball may have a hard feel on impact. On the other hand, if the surface of the core has a JIS-C hardness of less than 65, the ball may have a smaller rebound and less carry, the feel on impact may be too soft, and the resistance to cracking with repeated impact may worsen.

The inner core layer has a diameter of generally at least 15 mm, preferably at least 16 mm, and more preferably at least 17 mm, but generally not more than 28 mm, preferably not more than 25 mm, and more preferably not more than 22 mm. If this diameter is too small, the spin-reducing effect may be inadequate, which can shorten the distance traveled by the ball. On the other hand, if this diameter is too large, the outer core layer becomes relatively thin, which may worsen the durability of the ball to repeated impact. Moreover, the deflection amount of the entire core may become too soft, which may result in too low an initial velocity after impact and thus a short travel distance.

The outer core layer has a thickness of generally at least 4 mm, preferably at least 6 mm, and more preferably at least 8 mm, but generally not more than 13 mm. If the outer core layer is too thin, the durability to repeated impact may become unacceptably poor. On the other hand, if the outer core layer is too thick, the feel on impact may become too hard and the spin-reducing effect may be inadequate, which can shorten the carry of the ball.

The above-described inner core layer and/or outer core layer can be formed using a rubber composition containing, for example, a co-crosslinking agent, an organic peroxide, an inert filler and an organosulfur compound. It is preferable to use polybutadiene as the base rubber in the rubber composition.

The polybutadiene serving as the rubber component preferably has a content of cis-1,4 bonds on the polymer chain of at least 60 wt %, preferably at least 80 wt %, more preferably at least 90 wt %, and most preferably at least 95 wt %. Too few cis-1,4 bonds among the bonds in the molecule may lower the rebound of the ball.

The polybutadiene preferably has a content of 1,2-vinyl bonds on the polymer chain of generally not more than 2%, preferably not more than 1.7%, and more preferably not more than 1.5%. Too high a content of 1,2-vinyl bonds may lower the rebound of the ball.

To obtain a molded and vulcanized product having a good resilience from the rubber composition, the polybutadiene used in the outer core layer is preferably one that has been synthesized using a rare-earth catalyst or a group VIII metal compound catalyst. Of these, a polybutadiene synthesized with a rare-earth catalyst is especially preferred. The use of such a polybutadiene tends to result in a greater hardness, thus enabling the outer core layer to be easily fabricated.

The rare-earth catalyst is not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of lanthanide series rare-earth compounds include halides, carboxylates, alcoholates, thioalcoholates and amides of metals having an atomic number of 57 to 71.

The use of a neodymium catalyst in which a neodymium compound serves as the lanthanide series rare-earth compound is preferable for obtaining polybutadiene rubber having a high content of 1,4-cis bonds and a low content of 1,2-vinyl bonds. Preferred examples of such rare-earth catalysts include those mentioned in JP-A 11-35633, JP-A 11-164912 and JP-A 2002-293996.

To enhance the rebound, it is advantageous for polybutadiene synthesized using a lanthanide series rare-earth compound catalyst to account for at least 10 wt %, preferably at least 20 wt %, and most preferably at least 40 wt %, of the rubber composition.

The rubber base may include also rubber ingredients other than the above-described polybutadiene, insofar as the objects of the invention can be obtained. Illustrative examples of rubber ingredients other than the above-described polybutadiene include other polybutadienes, diene rubbers other than polybutadiene (e.g., styrene-butadiene rubber), natural rubber, isoprene rubber, and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid, and fumaric acid. Acrylic acid and methacrylic acid are especially preferred.

No particular limitation is imposed on the metal salts of unsaturated carboxylic acids. Examples include the above unsaturated carboxylic acids neutralized with a desired metal ion. Specific examples include the zinc salts and magnesium salts of methacrylic acid and acrylic acid. Zinc acrylate is especially preferred.

When used in the outer core layer, the above-described unsaturated carboxylic acid and/or metal salt thereof is included in an amount, per 100 parts by weight of the base rubber, of generally at least 10 parts by weight, preferably at least 15 parts by weight, and more preferably at least 20 parts by weight, but generally not more than 60 parts by weight, preferably not more than 50 parts by weight, more preferably not more than 45 parts by weight, and most preferably not more than 40 parts by weight. When used in the inner core layer, the unsaturated carboxylic acid and/or metal salt thereof is included in an amount, per 100 parts by weight of the base rubber, of generally at least 5 parts by weight, preferably at least 7 parts by weight, and more preferably at least 9 parts by weight, but generally not more than 20 parts by weight, preferably not more than 17 parts by weight, and more preferably not more than 15 parts by weight. Too much may make the core too hard, giving the ball an unpleasant feel on impact, whereas too little may lower the rebound of the ball.

The organic peroxide may be a commercially available product, illustrative examples of which include Percumil D (produced by NOF Corporation), Perhexa 3M (NOF Corporation) and Luperco 231XL (Atochem Co.). These may be used singly or as combinations of two or more thereof.

The amount of organic peroxide included per 100 parts by weight of the base rubber is generally at least 0.1 part by weight, preferably at least 0.2 part by weight, more preferably at least 0.3 part by weight, and even more preferably at least 0.4 part by weight, but generally not more than 5 parts by weight, preferably not more than 4 parts by weight, more preferably not more than 3 parts by weight, and most preferably not more than 2 parts by weight. Too much or too little organic peroxide may make it impossible to achieve a good feel on impact, durability and rebound.

Preferred examples of the inert filler include zinc oxide, barium sulfate and calcium carbonate. These may be used singly or as combinations of two or more thereof.

The amount of inert filler included per 100 parts by weight of the base rubber is generally at least 1 part by weight, and preferably at least 5 parts by weight, but generally not more than 50 parts by weight, preferably not more than 40 parts by weight, more preferably not more than 30 parts by weight, and even more preferably not more than 20 parts by weight. Too much or too little inert filler may make it impossible to achieve a proper weight and a suitable rebound.

In addition, the rubber composition may optionally include an antioxidant. For example, a commercial antioxidant such as Nocrac NS-6, Nocrac NS-30 (both available from Ouchi Shinko Chemical Industry Co., Ltd.), and Yoshinox 425 (available from Yoshitomi Pharmaceutical Industries, Ltd.) may be used for this purpose. These may be used singly or as combinations of two or more thereof.

The amount of antioxidant included per 100 parts by weight of the base rubber is 0 or more part by weight, preferably at least 0.05 part by weight, and more preferably at least 0.1 part by weight, but generally not more than 3 parts by weight, preferably not more than 2 parts by weight, more preferably not more than 1 part by weight, and even more preferably not more than 0.5 part by weight. Too much or too little antioxidant may make it impossible to give the golf ball a good rebound and durability.

To enhance the rebound by the golf ball and increase its initial velocity, it is preferable to include an organosulfur compound in the inner core layer and/or outer core layer.

No particular limitation is imposed on the organosulfur compound, provided it improves the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of the organosulfur compound included per 100 parts by weight of the base rubber is generally at least 0.05 part by weight, preferably at least 0.1 part by weight, and more preferably at least 0.2 part by weight. An improvement in rebound cannot be expected with the addition of too little organosulfur compound. At the same time, the amount of the organosulfur compound included per 100 parts by weight of the base rubber is generally not more than 2.5 parts by weight, preferably not more than 2 parts by weight, and more preferably not more than 1.0 part by weight. The use of too much organosulfur compound may make it impossible to achieve a further improvement in rebound, particularly an improvement in rebound when the ball is hit with a driver (W#1), and may also make the core too soft, giving the ball a poor feel on impact.

Production of the inner core layer can be carried out by molding the inner core layer using, for example, a conventional method in which the rubber composition is formed into a spherical shape under heating and compression at a temperature of at least 140° C. but not more than 180° C. for a period of at least 10 minutes but not more than 60 minutes. The rubber base used in the outer core layer which encloses the inner core layer may be the same rubber base as in the inner core layer or a different rubber base.

No particular limitation is imposed on the method of forming the outer core layer on the surface of the inner core layer. For example, use can be made of a method in which a pair of half-cups is formed using sheets of unvulcanized rubber, an inner core layer is placed inside these cups and enclosed therewith, and molding is carried out under heat and pressure. Preferred use can be made of, for example, a production process in which initial vulcanization (semi-vulcanization) is carried out to produce a pair of hemispherical cups, following which a prefabricated inner core layer is placed in one of the hemispherical cups and covered by the other hemispherical cup, then is subjected to secondary vulcanization (complete vulcanization). Another preferred production process involves forming the rubber composition into a sheet while in an unvulcanized state so as to make a pair of outer core layer sheets, and shaping the sheets with a die having hemispherical protrusions so as to produce unvulcanized hemispherical cups. The pair of hemispherical cups is then placed over a prefabricated inner core layer and formed into a spherical shape under heating and compression at a temperature of 140 to 180° C. for a period of 10 to 60 minutes.

The cover layer in the present invention is formed primarily of an ionomer resin. This ionomer resin is the best material for manifesting the high rebound, spin-reducing and high durability effects of the invention. Any of various commercially available ionomer resins can be suitably selected in order to achieve the desired hardness and flow properties. Specific examples include those available from DuPont-Mitsui Polychemicals Co., Ltd. under the trade name Himilan, those available from E.I. DuPont de Nemours & Co. under the trade name Surlyn, and those available from ExxonMobil Chemical under the trade name Iotek.

If necessary, various thermoplastic elastomers can be added. Exemplary thermoplastic elastomers include polyesters, polyamides, polyurethanes, polyolefins and styrenes. Illustrative examples of suitable commercial products include those available under the following trade names: Hytrel (produced by Du Pont-Toray Co., Ltd.), Perprene (Toyobo Co., Ltd.), Pebax (Toray Industries, Inc.), Pandex (DIC), Santoprene (Monsanto Chemical Co.), Tuftec (Asahi Kasei Kogyo Co., Ltd.) and Dynaron (JSR Corporation).

The cover is made of one or more layer and has an overall thickness in a range of generally 1.0 to 3.0 mm, preferably 1.2 to 2.5 mm, and more preferably 1.5 to 2.0 mm. If the overall thickness of the cover is too small, the durability of the ball to cracking from repeated impact may worsen. On the other hand, if the overall thickness of the cover is too large, the feel of the ball when hit with a putter and in the short game may worsen or the spin rate when the ball is hit with a driver (W#1) may increase so that a sufficient distance of travel cannot be achieved.

The cover has a hardness, expressed as the JIS-C hardness, of 80 to 99, preferably 83 to 96, and more preferably 87 to 92. Too soft a cover may make the ball too receptive to spin, as a result of which it may have insufficient rebound, lowering the distance of travel, in addition to which the scuff resistance of the ball may worsen. On the other hand, if the cover is to hard, the durability to cracking with repeated impact may decrease and the feel of the ball during the short game and when hit with a putter may worsen.

A known method such as injection molding or compression molding may be used to form the cover around the core. The cover can easily be formed by suitably selecting conditions such as the injection temperature and time within the ranges normally employed.

In this invention, the distance traveled by the ball, the feel of the ball on impact, and the scuff resistance are improved by limiting the hardness relationship between the cover layer composed primarily of ionomer resin and the core and the hardness relationship between the interior and exterior of the core itself so as to satisfy the following conditions (1) to (3):

(1) (JIS-C hardness of cover)−(JIS-C hardness at center of core)≧27, (2) 23≦(JIS-C hardness at surface of core)−(JIS-C hardness at center of core)≦40, and (3) 0.50≦[(deflection amount of entire core)/(deflection amount of inner core layer)]≦0.75.

Condition (1)

It is essential for the difference between the JIS-C hardness of the cover and the JIS-C hardness at the center of the core to be at least 27, with the preferred range being 30 to 50, and especially 35 to 45. If this value is too small, the ball takes on too much spin, shortening the distance traveled. On the other hand, if this value is too large, the rebound may become too small, shortening the distance, in addition to which the durability to cracking with repeated impact may worsen. Accordingly, in the practice of this invention, satisfying above condition (1) is important for achieving the objects of the invention.

Condition (2)

It is essential for the difference between the JIS-C hardness at the surface of the core and the JIS-C hardness at the center of the core to be from 23 to 40, with the preferred range being 24 to 35, and especially 25 to 30. If this value is too small, the ball takes on too much spin, shortening the distance traveled. On the other hand, if this value is too large, the durability to cracking with repeated impact worsens. Accordingly, in the practice of this invention, satisfying above condition (2) is important for achieving the effects of the invention.

Condition (3)

It is essential for the deflection amount of the entire core divided by the deflection amount of the inner core layer to be from 0.50 to 0.75, with the preferred range being 0.53 to 0.70, and especially 0.56 to 0.67. If this value is too small or too long, when the ball is hit with a number one wood, the spin rate becomes too high or the initial velocity becomes too low, resulting in an insufficient distance. Accordingly, in the practice of this invention, satisfying above condition (3) is important for achieving the effects of the invention.

Here, "deflection amount" refers to the amount of deformation (mm) by a spherical object such as the entire core or the inner core layer when a final load of 1,275 N (130 kfg) is applied from an initial load state of 98 N (10 kgf).

In the practice of the invention, in addition to above conditions (1) to (3), it is desirable to satisfy also the following hardness condition:

(4) 5≦(JIS-C hardness of cover)−(JIS-C hardness at surface of core)≦20.

The difference in JIS-C hardness between the cover and the surface of the core is preferably from 7 to 18, and more preferably from 9 to 16. If this difference is too large, the feel on impact with a putter or in the short game may worsen, or the durability to cracking with repeated impact may worsen. On the other hand, if this hardness difference is too small, the ball may acquire too high a spin rate, possibly shortening the distance of travel.

In addition, it is desirable as well to optimize the deflection amount of the ball divided by the deflection amount of the entire core. This value is generally from 0.75 to 0.95, preferably from 0.80 to 0.92, and more preferably from 0.82 to 0.90. If this value is too small or too large, the spin rate of the ball when hit with a number one wood may increase or the rebound may decrease, possibly shortening the distance traveled by the ball.

In the practice of the invention, numerous dimples are formed on the surface of the cover. The number of dimples arranged on the surface of the cover is from 250 to 390, preferably from 270 to 370, and more preferably from 300 to 350. If the number of dimples is greater than the above range, the ball will have a low trajectory, shortening the distance of travel. On the other hand, if the number of dimples is too small, the trajectory of the ball becomes so high as to prevent the ball from traveling a longer distance. The dimples may have a circular shape, any of various polygonal shapes, a dew drop shape, or an elliptical shape. Any one or combination of two or more of these shapes may be suitably used. For example, if circular dimples are to be used, dimples with a diameter of about 2.5 to 6.5 mm may be suitably selected.

The relationship between an imaginary sphere defined by the surface of the golf ball were it to have no dimples thereon and the golf ball having dimples, expressed as the ratio {(volume of imaginary sphere−volume of golf ball)/volume of imaginary sphere}×100, is preferably from 1.1 to 1.6%, and especially from 1.2 to 1.5%. If this ratio is less than 1.1%, the ball when hit will have too high a trajectory in flight. On the other hand, if this ratio is larger than 1.6%, the ball will not achieve sufficient height and will lose speed.

By suitably using at least four types of dimples, the dimples can be made to cover a spherical surface in a balanced and uniform manner. The types of dimples are not subject to any particular limitation, although the dimples can be disposed on the spherical surface in a polyhedral arrangement suitable for dimple placement, such as a repeating pattern of unit polygons (e.g., unit triangles, unit pentagons). It is also possible to use dimples which all have slightly different diameters. In such a case, the number of dimple types may be set at twenty or more. To be able to fully manifest aerodynamic properties, it is desirable for the dimple occupancy, which is the proportion of the golf ball's spherical surface occupied by dimples, to be at least 78%.

In addition, the use of dimples surrounded by a land having a substantially constant cross-sectional shape is effective for enhancing the distance traveled by the ball. This technique enables substantially the entire surface of the ball to be covered with dimples, and thus has an aerodynamic resistance-reducing effect.

To increase the distance traveled by a golf ball, it is regarded as desirable for the ball to have a low coefficient of drag CD at high velocity and a high coefficient of lift CL at low velocity. In the golf ball of the invention, it is preferable for the ball when hit to have a coefficient of lift CL at a Reynolds number of 70,000 and a spin rate of 2,000 rpm that is at least 70% of the coefficient of lift CL at a Reynolds number of 80,000 and a spin rate of 2,000 rpm, and to have a coefficient of drag CD at a Reynolds number of 180,000 and a spin rate of 2,520 rpm of not more than 0.225. This is explained below.

Obtaining a ball which, when hit with a club designed for long shots such as a number one wood (driver), has a long carry, is particularly resistant to wind effects and has a good run, requires a suitable balance of lift and drag on the ball that has been hit. This balance depends on the construction of the ball and the materials used in the ball, and also depends on a number of dimple parameters, including the type and total number of dimples, the dimple surface coverage and total volume of the dimples on the ball.

Figure 2:
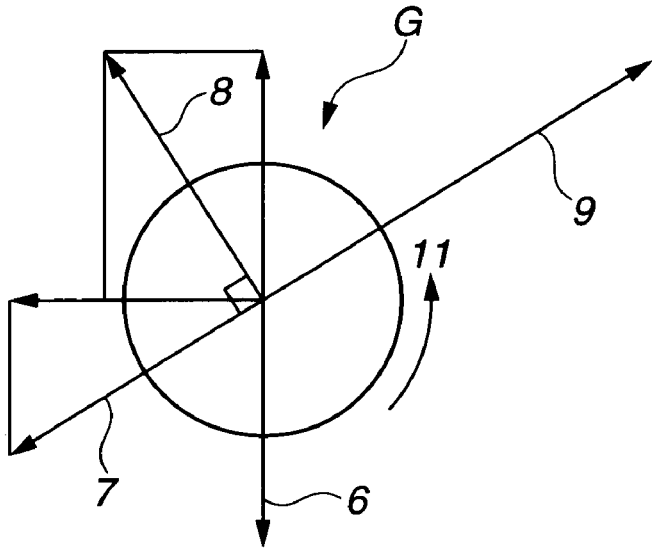
FIG. 2 is a diagram illustrating the relationship between lift and drag on a golf ball in flight.

As shown in FIG. 2, a golf ball G in flight that has been hit by a club is known to incur gravity 6, air resistance (drag) 7, and also lift 8 due to the Magnus effect because the ball has spin. Also indicated in the same diagram are the direction of flight 9 and the direction 11 in which the ball G is spinning.

The forces acting upon the golf ball in this case are represented by the following trajectory equation (1).

$$F=FL+FD+Mg \quad (1)$$

where

F: forces acting upon golf ball

FL: lift

FD: drag

Mg: gravity

The lift FL and drag FD in the trajectory equation (1) are given by formulas (2) and (3) below.

$$FL=0.5\times CL\times\rho\times A\times V^2 \quad (2)$$

$$FD=0.5\times CD\times\rho\times A\times V^2 \quad (3)$$

where

CL: coefficient of lift

CD: coefficient of drag

ρ: air density

A: maximum cross-sectional surface area of golf ball

V: air velocity with respect to golf ball

To improve the carry of the ball, decreasing the drag or the drag coefficient CD is not that effective by itself. Making only the drag coefficient small will extend the position of the ball at the highest point of its trajectory, but in the low-velocity region after the highest point, the ball will drop due to insufficient lift and thus tend to lose carry.

It is thus preferable for the multi-piece solid golf ball of the invention to have a drag coefficient CD at a Reynolds number of 180,000 and a spin rate of 2,520 rpm just after it has been hit of not more than 0.225, and to retain a lift coefficient CL at a Reynolds number of 70,000 and a spin rate of 2,000 rpm when the ball has been hit that is at least 70% of its lift coefficient CL at a Reynolds number of 80,000 and a spin rate of 2,000 rpm. The Reynolds number of 180,000 just after the ball has been hit corresponds to a ball velocity of about 66 m/s, and the Reynolds numbers of 80,000 and 70,000 correspond respectively to velocities of about 30 m/s and 26 m/s.

The multi-piece solid golf ball of the invention can be manufactured in accordance with the Rules of Golf for use in competitive play, in which case the ball may be formed to a diameter which is sized so that the ball will not pass through a ring having an inside diameter of 42.672 mm but is not more than 42.80 mm, and to a weight of generally 45.0 to 45.93 g.

In the present invention, the ball has an initial velocity of at least 76.8 m/s, and preferably at least 77.0 m/s, but preferably not more than 77.724 m/s. Too low an initial velocity may result in a poor distance, whereas too high an initial velocity may place the golf ball outside the specifications set by the Royal and Ancient Golf Club of St. Andrews (R&A) and the United States Golf Association (USGA), making it unfit for use as an officially approved ball.

"Initial velocity," as used herein, refers to the value measured using an initial velocity measuring apparatus of the same type as the USGA drum rotation-type initial velocity instrument approved by the R&A. The ball was temperature conditioned within this apparatus at 23±1° C. for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity of the ball. This cycle was carried out over a period of about 15 minutes.

As explained above, in the multi-piece solid golf ball of the invention, the core is formed so as to be soft on the inside and hard on the outside, thus reducing spin, and optimal dimples have been provided on this ball construction. As a result, a better travel distance is achieved and the ball has an excellent feel upon impact and an excellent scuffing resistance.

EXAMPLES

The following Examples of the invention and Comparative Examples are provided by way of illustration and not by way of limitation.

Examples 1 and 2, Comparative Examples 1 to 6

In each example, the rubber composition formulated as shown in Table 1 was vulcanized at 155° C. for 17 minutes, then the surface was ground to form an inner core layer. In a separate procedure, the rubber composition formulated in parts by weight as shown in Table 2 was rendered in the unvulcanized state into sheets so as to prepare a pair of outer core layer sheets, and these sheets were shaped with a die having hemispherical protrusions. The outer core layer sheets were placed along the cavity of the core mold and the inner core layer was enclosed within this shaped unvulcanized rubber, which was then vulcanized at 155° C. for 15 minutes. The surface of the resulting vulcanized body was subsequently ground, thereby giving a two-layer core composed of an inner layer and an outer layer.

Next, cover stock A or cover stock B formulated as shown in Table 3 below was injection molded over the core, yielding a multi-piece golf ball.

Test results for the golf balls thus obtained are given in Table 4.

TABLE 1

| | | Example | | Comparative Example | | | | | |
|---|---|---|---|---|---|---|---|---|---|
| Parts by weight | | 1 | 2 | 1 | 2 | 3 | 4 | 5 | 6 |
| Inner core layer formulations | Polybutadiene A | 100 | 100 | 100 | 100 | | 100 | 100 | 100 |
| | Polybutadiene B | 0 | 0 | 0 | 0 | | 0 | 0 | 0 |
| | Zinc acrylate | 12 | 12 | 12 | 11 | | 12 | 12 | 11 |
| | Peroxide (1) | 0.6 | 0.6 | 0.6 | 0.6 | | 0.6 | 0.6 | 0.6 |
| | Peroxide (2) | 0.6 | 0.6 | 0.6 | 0.6 | | 0.6 | 0.6 | 0.6 |
| | Antioxidant | 0.1 | 0.1 | 0.1 | 0.1 | | 0.1 | 0.1 | 0.1 |

TABLE 1-continued

| Parts by weight | Example 1 | Example 2 | Comparative Example 1 | Comparative Example 2 | Comparative Example 3 | Comparative Example 4 | Comparative Example 5 | Comparative Example 6 |
|---|---|---|---|---|---|---|---|---|
| Zinc oxide | 27.9 | 27.9 | 27.9 | 29.3 | | 27.9 | 27.9 | 28.3 |
| Zinc pentachlorothiophenol | 0.3 | 0.3 | 0.3 | 0 | | 0.3 | 0.3 | 0.3 |
| Zinc stearate | 0 | 0 | 0 | 0 | | 0 | 0 | 0 |

TABLE 2

| | Parts by weight | Example 1 | Example 2 | Comparative Example 1 | Comparative Example 2 | Comparative Example 3 | Comparative Example 4 | Comparative Example 5 | Comparative Example 6 |
|---|---|---|---|---|---|---|---|---|---|
| Outer core layer formulations | Polybutadiene A | 0 | 0 | 0 | 100 | 100 | 100 | 0 | 0 |
| | Polybutadiene B | 100 | 100 | 100 | 0 | 0 | 0 | 100 | 100 |
| | Zinc acrylate | 26.0 | 30.5 | 26.0 | 24.3 | 22.5 | 17.2 | 26.0 | 26.0 |
| | Peroxide (1) | 0.3 | 0.3 | 0.3 | 0.6 | 0.6 | 0.6 | 0.3 | 0.3 |
| | Peroxide (2) | 0.3 | 0.3 | 0.3 | 0.6 | 0.6 | 0.6 | 0.3 | 0.3 |
| | Antioxidant | 0.1 | 0.1 | 0.1 | 0.1 | 0.1 | 0.1 | 0.1 | 0.1 |
| | Zinc oxide | 24.3 | 22.4 | 24.3 | 24.1 | 5 | 26.1 | 24.3 | 24.3 |
| | Barium sulfate | 0 | 0 | 0 | 0 | 20.7 | 0 | 0 | 0 |
| | Zinc pentachlorothiophenol | 0.1 | 0.3 | 0.1 | 0 | 0.2 | 0.1 | 0.1 | 0.1 |
| | Zinc stearate | 5 | 5 | 5 | 0 | 0 | 0 | 5 | 5 |

Note:
The overall core formulation for a single-layer core is shown in Comparative Example 3.

Polybutadiene A: Trade name, BROL (produced by JSR Corporation)

Polybutadiene B: Trade name, BR730 (produced by JSR Corporation)

Peroxide (1): Dicumyl peroxide having the trade name Percumyl D (produced by NOF Corporation)

Peroxide (2): 1,1-Bis(t-butylperoxy)-3,3,5-trimethylcyclohexane having the trade name Perhexa 3M-40 (produced by NOF Corporation)

Antioxidant: Nocrac NS-6 (produced by Ouchi Shinko Chemical Industry Co., Ltd.)

Zinc stearate: Trade name, Zinc Stearate G (produced by NOF Corporation)

TABLE 3

| Parts by weight | A | B |
|---|---|---|
| Himilan 1557 | 50 | 20 |
| Himilan 1601 | 50 | |
| Himilan 1855 | | 30 |
| Surlyn 8120 | | 30 |
| AN4311 | | 20 |
| Titanium dioxide | 2 | 2 |

Note:
Himilan 1557, 1601, 1855 are ionomers produced by Du Pont- Mitsui Polychemicals Co., Ltd.
Surlyn 8120: An ionomer produced by E. I. Du Pont de Nemours & Co.
AN4311: Nucrel, produced by Du Pont-Mitsui Polychemicals Co., Ltd.

TABLE 4

| | | Example 1 | Example 2 | Comparative Example 1 | Comparative Example 2 | Comparative Example 3 | Comparative Example 4 | Comparative Example 5 | Comparative Example 6 |
|---|---|---|---|---|---|---|---|---|---|
| Inner core layer | Diameter (mm) | 18.0 | 18.0 | 18.0 | 18.0 | — | 18.0 | 18.0 | 31.4 |
| | Deflection amount (mm) | 6.3 | 6.3 | 6.3 | 6.3 | — | 6.3 | 6.3 | 7.6 |
| | Center hardness (JIS-C) | 50 | 50 | 50 | 50 | — | 50 | 50 | 44 |
| Core (inner core layer + outer core layer) | Diameter (mm) | 39.1 | 39.1 | 39.1 | 39.1 | 39.1 | 39.1 | 39.1 | 39.3 |
| | Deflection amount (mm) | 3.8 | 3.6 | 3.8 | 3.8 | 3.8 | 4.3 | 3.8 | 6.7 |
| | Surface hardness (JIS-C) | 75 | 79 | 75 | 75 | 74 | 70 | 75 | 72 |
| | Surface hardness − center hardness (JIS-C) | 25 | 29 | 25 | 25 | 14 | 20 | 25 | 28 |
| Deflection amount of entire core/ Deflection amount of inner core layer (Hardness: 10–130 kgf) | | 0.61 | 0.58 | 0.61 | 0.61 | — | 0.68 | 0.61 | 0.88 |

TABLE 4-continued

| | | Example | | Comparative Example | | | | | |
|---|---|---|---|---|---|---|---|---|---|
| | | 1 | 2 | 1 | 2 | 3 | 4 | 5 | 6 |
| Cover | Material | A | A | B | A | A | A | A | A |
| | Sheet: Shore D hardness | 60 | 60 | 50 | 60 | 60 | 60 | 60 | 60 |
| | Sheet: JIS-C hardness | 89 | 89 | 76 | 89 | 89 | 89 | 89 | 89 |
| | Gage (mm) | 1.8 | 1.8 | 1.8 | 1.8 | 1.8 | 1.8 | 1.8 | 1.7 |
| Ball | Diameter (mm) | 42.7 | 42.7 | 42.7 | 42.7 | 42.7 | 42.7 | 42.7 | 42.7 |
| | Weight (g) | 45.5 | 45.5 | 45.5 | 45.5 | 45.5 | 45.5 | 45.5 | 45.4 |
| | Deflection amount (mm) | 3.3 | 3.0 | 3.4 | 3.3 | 3.3 | 3.7 | 3.3 | 5.0 |
| | Initial velocity (m/s) | 77.2 | 77.6 | 76.8 | 76.7 | 77.2 | 76.9 | 77.2 | 77.4 |
| Deflection amount of ball/ Deflection amount of core (inner core layer + outer core layer) | | 0.85 | 0.83 | 0.88 | 0.85 | 0.87 | 0.86 | 0.85 | 0.75 |
| Number of dimples | | 330 | 330 | 330 | 330 | 330 | 330 | 432 | 330 |
| Dimple volume ratio | | 1.35 | 1.35 | 1.35 | 1.35 | 1.35 | 1.35 | 1.25 | 1.35 |
| Aerodynamic properties | Low-velocity CL ratio | 82 | 82 | 82 | 82 | 82 | 82 | 65 | 82 |
| | High-velocity CD | 0.214 | 0.214 | 0.214 | 0.214 | 0.214 | 0.214 | 0.215 | 0.214 |
| Cover - Core surface hardness (JIS-C) | | 14 | 10 | 1 | 14 | 15 | 19 | 14 | 17 |
| Cover - Core center hardness (JIS-C) | | 39 | 39 | 26 | 39 | 29 | 39 | 39 | 45 |
| Flight performance (W#1) (HS, 45 m/s) | Total (m) | 232.3 | 232.6 | 228.8 | 229.9 | 230.9 | 228.1 | 230.2 | 227.1 |
| | Spin rate (rpm) | 2743 | 2835 | 2855 | 2762 | 2839 | 2688 | 2743 | 2333 |
| | Distance | Good | Good | NG | NG | NG | NG | NG | NG |
| Feel when hit with W#1 | | Good | Good | Good | Good | Good | Good | Good | NG |
| Feel when hit with putter | | Good | Good | Good | Good | Good | Good | Good | NG |
| Scuff resistance | | Good | Good | NG | Good | Good | Good | Good | Good |

Note:
Comparative Example 3 is a ball having a one-layer core. The center of the core has a JIS-C hardness of 60.

Deflection Amount of Inner Core Layer, Entire Core and Ball

The amount of deflection by the spherical object being tested when subjected, on a hard plate, to an increase in load from an initial load state of 98 N (10 kgf) to a load of 1,275 N (130 kgf).

Core Hardness (Center/Surface)

The core surface hardness was measured in accordance with JIS K6301-1993 after setting the durometer perpendicular to the core surface (at the surface of the sphere). To measure the core center hardness, the core was cut into two and the sectioned plane of the core was leveled, following which the hardness at the center thereof was measured in accordance with JIS K6301-1993.

Cover Hardness

The cover material was melted, formed into 1 mm-thick pressed sheets and left to stand for 14 days, following which six or more such sheets were stacked together and the hardness was measured in accordance with JIS K6301-1993 at 23° C.

Initial Velocity of Ball

The initial velocity was measured using an initial velocity measuring apparatus of the same type as the USGA drum rotation-type initial velocity instrument approved by the R&A. The ball was temperature conditioned at 23±1° C. for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity of the ball. This cycle was carried out over a period of about 15 minutes.

Dimples on Surface of Cover

Figure 3:
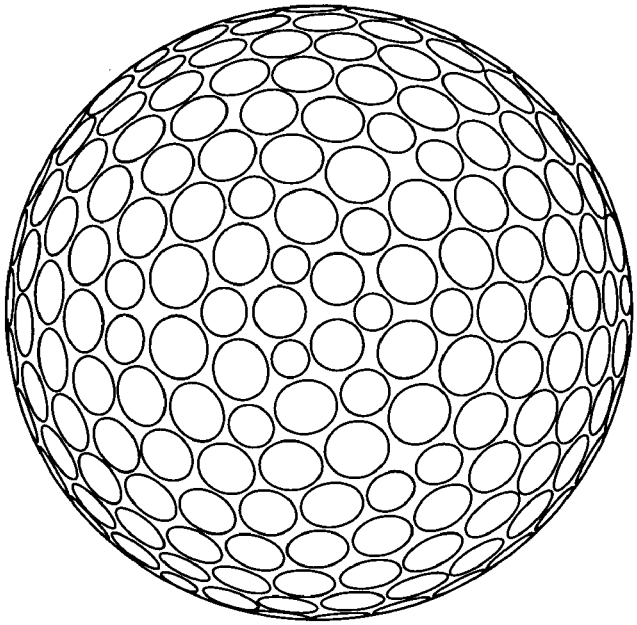
FIG. 3 is a plan view of a ball showing the dimples used in the examples of the invention.
Figure 4:
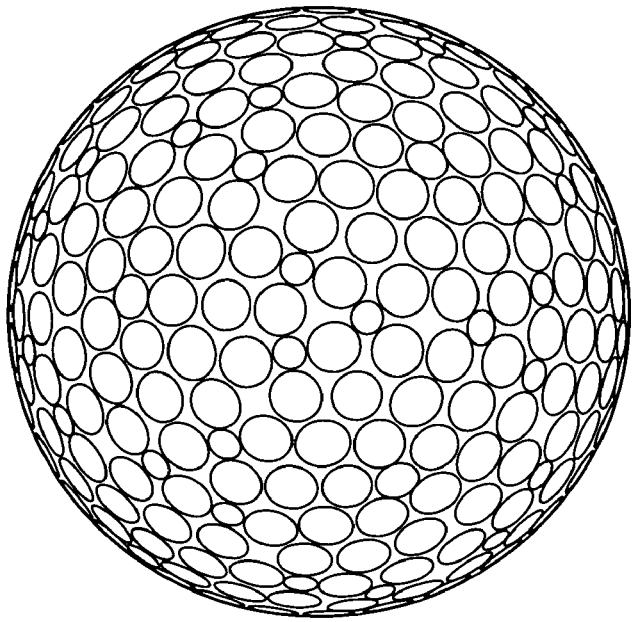
FIG. 4 is a plan view of a ball showing the dimples used in a comparative example.

In Comparative Example 5, the dimple arrangement shown in FIG. 4 was used on the surface of the ball. The number of these dimples was 432. In the examples of the invention and the comparative examples other than Comparative Example 5, the dimple arrangement shown in FIG. 3 was used. The number of these dimples was 330.

Dimple Volume Ratio

This value was computed from the following formula, assuming an imaginary sphere defined by the surface of the ball were it to have no dimples thereon.

$$\{(\text{volume of imaginary sphere} - \text{volume of golf ball}) / \text{volume of imaginary sphere}\} \times 100$$

Aerodynamic Properties (Low-Velocity CL Ratio, High-Velocity CD Value)

The low-velocity CL ratio was determined by calculating the ratio of the coefficient of life CL at a Reynolds number of 70,000 and a spin rate of 2,000 to the coefficient of lift CL at a Reynolds number of 80,000 and a spin rate of 2,000 rpm from the ball on its trajectory just after it has been launched with an Ultra Ball Launcher (UBL). The high-velocity CD was similarly obtained by measuring the drag coefficient at a Reynolds number of 180,000 and a spin rate of 2,520 rpm just after the ball was hit.

The UBL is a device which includes two pairs of drums, one on top and one on the bottom. The drums are turned by belts across the two top drums and across the two bottom drums. The UBL inserts a golf ball between the turning drums and launches the golf ball under the desired conditions. This device is manufactured by Automated Design Corporation.

Flight Performance

The distance traveled by the ball was measured when the ball was hit at a head speed of 45 m/s with a W#1 club mounted on a golf swing robot. The W#1 club was a Tour Stage X-Drive Type 300 with a loft of 9° manufactured by Bridgestone Sports Co., Ltd. The distance was rated according to the following criteria.

Good: Total distance of travel was at least 232.0 m

NG: Total distance of travel was less than 232.0 m

Feel When Hit with W#1 and Putter

Sensory evaluations were carried out with a panel of ten amateur golfers having head speeds of 45 to 50 m/s using W#1 clubs. Ratings were based on the following criteria.

Good: At least 7 of the 10 golfers thought the ball had a good feel

NG: Four or fewer of the 10 golfers thought the ball had a good feel

Scuff Resistance

A non-plated pitching sand wedge was set in a swing robot, and the ball was hit once at a head speed of 40 m/s. The surface state of the ball was then visually examined and rated according to the following criteria.

Good: The ball could be used again

NG: The ball could no longer be used

Test Results

In Comparative Example 1, the ball was formed with a soft cover and the (JIS-C hardness of cover)−(JIS-C hardness at center of core) value was less than 27. Hence, when the ball was hit with a number one wood, it had too high a spin rate and a low rebound, resulting in a poor distance. This ball also had a poor scuff resistance.

In Comparative Example 2, the core had a low resilience and the ball also had a low rebound. The ball thus had a poor distance.

In Comparative Example 3, the core consisted of only a single layer and the hardness difference between the surface and the center was small. As a result, the spin rate was too high, giving the ball a poor distance.

In Comparative Example 4, the hardness difference between the core surface and the core center was small. Hence, the spin could not be checked, resulting in a poor distance.

In Comparative Example 5, the number of dimples was 432. Hence, the aerodynamic properties were unsuitable for a low-spin construction, and so the distance traveled was unsatisfactory.

In Comparative Example 6, the (deflection amount of the entire core)/(deflection amount of the inner core layer) value was larger than 0.75, and so the outer core layer was too soft relative to the inner core layer. As a result, when the ball was hit, it had a low rebound and a poor distance.

The invention claimed is:

1. A multi-piece solid golf ball comprising a multilayer core having at least an inner core layer and an outer core layer, one or more cover layer which encloses the core, and numerous dimples formed on a surface of the cover layer, the golf ball being characterized in that at least one cover layer is made primarily of an ionomer resin, the following hardness conditions (1) to (3) are satisfied:

(1) (JIS-C hardness of cover)−(JIS-C hardness at center of core)≧27, (2) 23≦(JIS-C hardness at surface of core)−(JIS-C hardness at center of core)≦40, and (3) 0.50≦[(deflection amount of entire core)/(deflection amount of inner core layer)]≦0.75, the number of dimples is from 250 to 390, and the ball has an initial velocity of at least 76.8 m/s.

2. The multi-piece solid golf ball of claim 1, wherein the inner core layer and/or outer core layer contain an organosulfur compound.

3. The multi-piece solid golf ball of claim 1, wherein the inner core layer has an outside diameter of at least 15 mm but not more than 28 mm.

4. The multi-piece solid golf ball of claim 1 wherein, assuming an imaginary sphere defined by the surface of the ball were it to have no dimples thereon, {(volume of imaginary sphere−volume of golf ball)/volume of imaginary sphere}×100=1.1 to 1.6%.

5. The multi-piece solid golf ball of claim 1 which, when hit, has a coefficient of lift CL at a Reynolds number of 70,000 and a spin rate of 2,000 rpm that is at least 70% of the coefficient of lift CL at a Reynolds number of 80,000 and a spin rate of 2,000 rpm, and has a coefficient of drag CD at a Reynolds number of 180,000 and a spin rate of 2,520 rpm of not more than 0.225.

6. The multi-piece solid golf ball of claim 1 wherein condition (3) is 0.53≦[(deflection amount of entire core)/(deflection amount of inner core layer)]≦0.70.

7. The multi-piece solid golf ball of claim 1 wherein the outer core layer is made of rubber as the base material, which rubber base contains polybutadiene rubber synthesized with a rare-earth catalyst or a group VIII metal compound catalyst.

8. The multi-piece solid golf ball of the claim 1, wherein the following hardness condition (4) is satisfied:

(4) 5≦(JIS-C hardness of cover)−(JIS-C hardness at surface of core)≦20.

* * * * *